US007589476B2

(12) United States Patent
Parker et al.

(10) Patent No.: US 7,589,476 B2
(45) Date of Patent: Sep. 15, 2009

(54) POWER SUPPLY FOR EXTERNAL ELECTRODE FLUORESCENT LAMPS

(75) Inventors: Francis J. Parker, Cooper City, FL (US); Robert Crawbuck, Jupiter, FL (US); Emilian Padurariu, West Palm Beach, FL (US)

(73) Assignee: Inshore Holdings, LLC, Miami, FL (US)

( * ) Notice: Subject to any disclaimer, the term of this patent is extended or adjusted under 35 U.S.C. 154(b) by 143 days.

(21) Appl. No.: 11/999,568

(22) Filed: Dec. 6, 2007

(65) Prior Publication Data

US 2009/0146586 A1 Jun. 11, 2009

(51) Int. Cl.
*H05B 37/02* (2006.01)

(52) U.S. Cl. ..... 315/219; 315/224; 315/307; 315/DIG. 7

(58) Field of Classification Search ..... 315/224, 315/291, DIG. 5, DIG. 7, 219, 312, 307
See application file for complete search history.

(56) References Cited

U.S. PATENT DOCUMENTS 6,879,114 B2 * 4/2005 Jales et al. ..... 315/209 R
7,443,113 B2 * 10/2008 Crouse et al. ..... 315/308

* cited by examiner

*Primary Examiner*—David Hung Vu
(74) *Attorney, Agent, or Firm*—Lucas & Mercanti, LLP; Peter J. Phillips

(57) ABSTRACT

The present invention provides a power supply circuit for providing power for a plurality of external electrode fluorescent lamps (EEFLs) connected in parallel, comprising a controllable voltage regulator for receiving an input power signal and for providing a regulated voltage signal, an output inverter and a resonant circuit connected to receive the regulated voltage signal and for providing a resonant frequency signal, a voltage transformation stage for receiving the resonant frequency signal for transforming the resonant frequency signal to a power voltage signal capable of driving a plurality of EEFLs connected in parallel, wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

14 Claims, 4 Drawing Sheets

POWER SUPPLY FOR EXTERNAL ELECTRODE FLUORESCENT LAMPS

BACKGROUND OF THE INVENTION

The present invention relates to power supplies for External Electrode Fluorescent Lamps (EEFLs).

Conventional fluorescent lamps and neon tubes employ electrodes sealed within the lamp, and to which power connections are made. These conventional lamps have low slope impedance around the normal running voltage of the lamp. Because of this, a constant current supply is used to feed the lamps. Each lamp must have its own constant current supply, unless the lamps are connected in series.

An EEFL does not have an electrode inside the lamp. Instead a metal end cap is used, which surrounds the end of the tube, and to which power is supplied. The voltage field around each end cap allows the internal gas in the lamp to become ionized, and produce an electrical discharge between the ends of the lamp. The capacitance of the metal end caps to the ionized gas provides an impedance to current flow, and which can be used to control the current flowing in the lamp.

A constant voltage source is typically used for EEFLs with the voltage frequency set to such a level that the required lamp current is achieved.

SUMMARY OF THE INVENTION

It is an object of the invention to provide a power supply for EEFL which provides a constant voltage supply so that lamps can be placed in parallel across the output of the power supply.

It is an object of the present invention to provide a power supply for EEFLs connected in parallel wherein the voltage and frequency are maintained relatively constant in order to provide the proper current to flow in each lamp connected in parallel across the output of the power supply.

The present invention provides a power supply circuit for providing power for a plurality of external electrode fluorescent lamps (EEFLs) connected in parallel, comprising a controllable voltage regulator for receiving an input power signal and for providing a regulated voltage signal, an output inverter and a resonant circuit connected to receive the regulated voltage signal and for providing a resonant frequency signal, a voltage transformation stage for receiving the resonant frequency signal for transforming the resonant frequency signal to a power voltage signal capable of driving a plurality of EEFLs connected in parallel, wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

The invention provides a power supply circuit for providing power for a plurality of external electrode fluorescent lamps (EEFLs) connected in parallel, comprising an input rectifier for receiving an AC voltage input power signal and for rectifying the AC voltage input power signal into a rectified signal, a controllable voltage regulator for receiving the rectified signal and for providing a regulated voltage signal, an over-voltage protection circuit for receiving the regulated supply voltage signal and for suppressing any over-voltage conditions on the regulated voltage signal, an output inverter and a resonant circuit connected to receive the regulated voltage signal and for providing a resonant frequency signal, a voltage transformation stage for receiving the resonant frequency signal and for stepping up the voltage to a higher voltage suitable for providing a power voltage for a plurality of EEFLs, wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

DETAILED DESCRIPTION OF THE PREFERRED EMBODIMENTS

Figure 1:
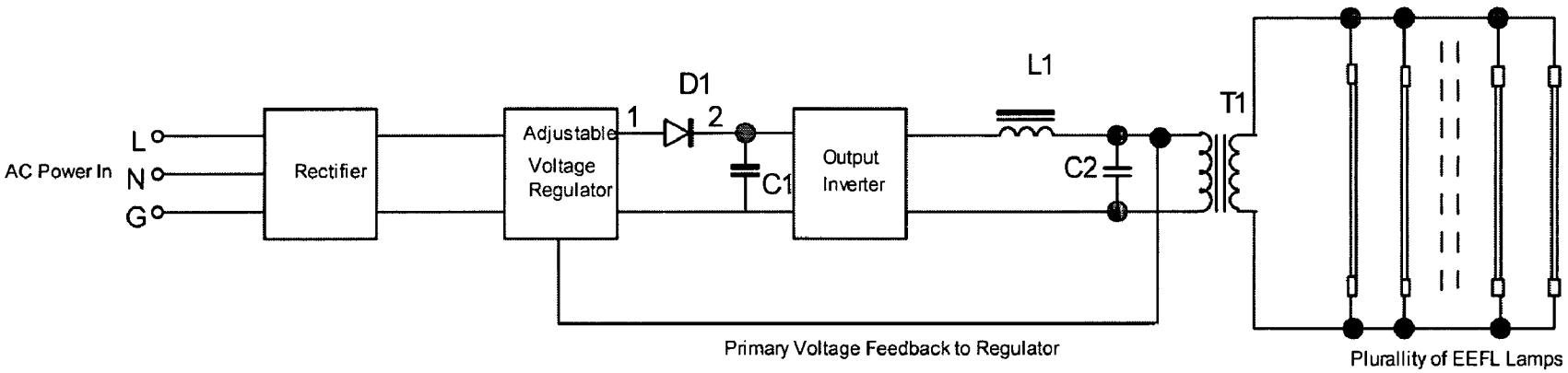
FIG. 1 is a block diagram of an embodiment of a power supply according to the invention.

A preferred embodiment of the invention will now be described, but the invention is not limited to this preferred embodiment.

The present invention provides a power supply circuit for providing power for a plurality of external electrode fluorescent lamps (EEFLs) connected in parallel, comprising a controllable voltage regulator for receiving an input power signal and for providing a regulated voltage signal, an output inverter and a resonant circuit connected to receive the regulated voltage signal and for providing a resonant frequency signal, a voltage transformation stage for receiving the resonant frequency signal for transforming the resonant frequency signal to a power voltage signal capable of driving a plurality of EEFLs connected in parallel, wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

The resonant circuit may comprise an inductor and capacitor. The voltage transformation stage may comprise a step-up voltage transformer. The resonant circuit and voltage transformation stage may comprise a single magnetic component in the form of a transformer having a high leakage reactance between primary and secondary windings, to provide a step up transformer and an inductor, the inductor forming the resonant circuit with a capacitor. The power supply circuit may further comprise an input rectifier for receiving an AC voltage input power signal and for providing a rectified signal to the controllable voltage regulator. The resonant frequency supply voltage may have a power factor of at least 0.9. The power voltage signal may be a sinusoidal wave form signal having a voltage of about 2200-2400 VAC and a frequency of about 65-80 kHz. The power supply circuit may further comprise an over-voltage protection circuit between the controllable voltage regulator and output inverter. The output inverter may produce a rectangular waveform signal and wherein the resonant circuit provides an sinusoidal signal of about 150-180 volts RMS at a frequency of about 65-80 kHz.

The invention provides a power supply circuit for providing power for a plurality of external electrode fluorescent lamps (EEFLs) connected in parallel, comprising an input rectifier for receiving an AC voltage input power signal and for rectifying the AC voltage input power signal into a rectified signal, a controllable voltage regulator for receiving the rectified signal and for providing a regulated voltage signal, an over-voltage protection circuit for receiving the regulated supply voltage signal and for suppressing any over-voltage conditions on the regulated voltage signal, an output inverter and a resonant circuit connected to receive the regulated voltage signal and for providing a resonant frequency signal, a voltage transformation stage for receiving the resonant frequency signal and for stepping up the voltage to a higher voltage suitable for providing a power voltage for a plurality of EEFLs, wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

The resonant circuit and voltage transformation stage may comprise a single magnetic component in the form of a transformer having a high leakage reactance between primary and secondary windings, to provide a step up transformer and an inductor, the inductor forming the resonant circuit with a computer. The resonant frequency supply voltage may have a power factor of at least 0.9. The power voltage signal may be a sinusoidal wave form signal having a voltage of about 2200-2400 VAC and a frequency of about 65-80 kHz. The power supply circuit may further comprise an over-voltage protection circuit between the controllable voltage regulator and output inverter.

FIG. 1 is a block diagram of an embodiment of a power supply according to the invention. In FIG. 1, the input 110V AC 60 Hz voltage is rectified to flip the negative sine wave portions to positive to thereby produce an unfiltered rectified signal. This unfiltered rectified signal is then fed to a voltage regulating stage, whose output voltage can be adjusted in response to a control signal. The output voltage from the regulator produces a DC voltage on capacitor C1 by means of rectifier D1, and the resulting DC voltage on C1 then feeds an output inverter, which has a symmetrical rectangular waveform. While the block diagram assumes a half or full bridge inverter for the purpose of simplicity, the topology may be half bridge, full bridge or push-pull.

The rectangular wave form output from the inverter stage is isolated from DC by means of a capacitor (not shown in FIG. 1), and is fed to a resonant circuit comprising inductor L1 and capacitor C2. This is resonant at a frequency that is at, or slightly below, the operating frequency of the inverter when running with a minimum number of EEFL lamps. This resonant circuit converts the rectangular waveform outputted from the output inverter to a sine waveform having a voltage of 150-180 volts RMS (frequency 65-80 kHz), which is then applied to the primary of the step up transformer T1 so as to generate the required voltage of 2200-2400 volts (65-80 kHz) for lamp operation.

As the number of lamps connected to the power supply is increased, the resonant frequency will fall due to the external electrode capacitance of each lamp. The Q of the circuit will also fall due to the power dissipated in each additional lamp. In order to maintain the required lamp voltage with an increasing number of lamps connected across the output of the power supply, the voltage across C1 should be increased. The voltage on the primary of T1 is of course proportional to the output voltage as the primary and secondary of T1 are tightly coupled. This primary voltage is therefore fed back to the voltage regulator stage, where it is rectified and compared with a stable reference source. The resulting error signal is then fed to the input of the voltage regulator and results in an increase of the voltage across C1 as the lamp load is increased, which in turn maintains a constant voltage on the primary of T1. The voltage at C1 will be about 40 volts if 1 lamp is driven and about 180-200 volts if 12 lamps are driven.

In one implementation of the circuit, the voltage regulator is a Power Factor Control (PFC) stage. This is in essence a fly back converter which is arranged so that the current drawn by it results in a sinusoidal current at the AC input. The preferred implementation of the power factor stage differs somewhat from the normal power factor controller. In the normal circuit, the output voltage is boosted above the input line voltage. The preferred implementation in this case has an isolated output, which produces a DC voltage on capacitor C1 by means of rectifier D1. This arrangement allows the voltage on C1 to be controlled down to near zero volts.

Figure 2:
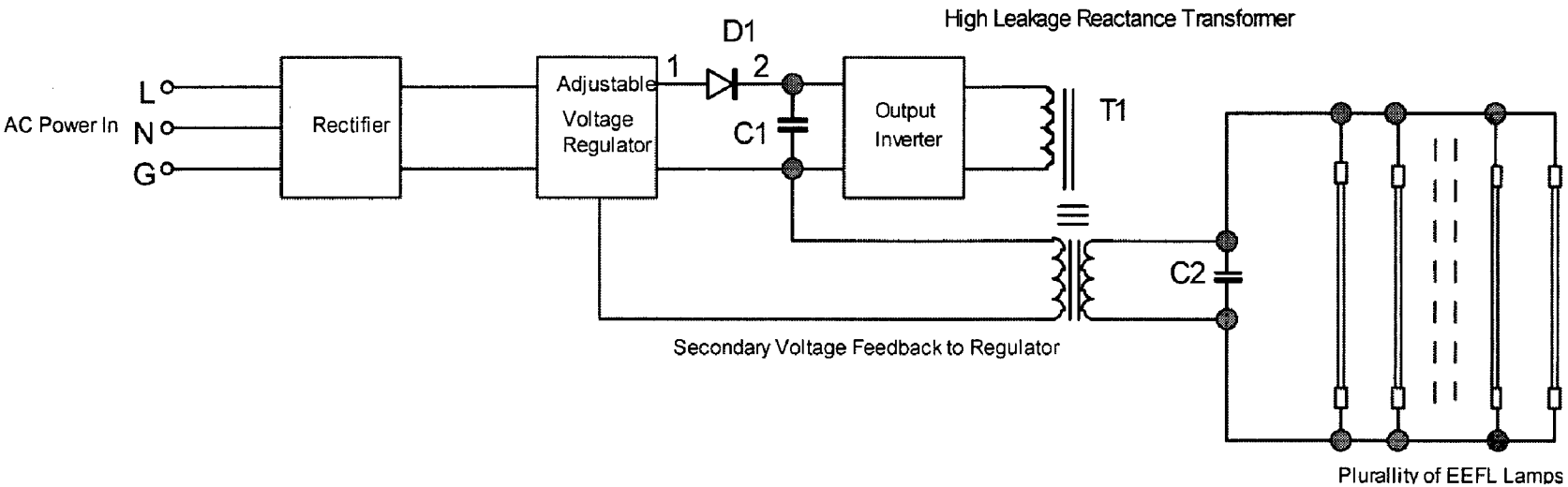
FIG. 2 is an alternate implementation of an embodiment of an output circuit according to the invention.

The discrete output circuit inductor and transformer of FIG. 1 may be replaced by a transformer having a high leakage reactance between the primary and secondary windings, thus fulfilling the function of the series inductor and the output transformer. This alternate implementation is shown in FIG. 2. This form of the circuit has the resonating capacitor C2 across the secondary of the transformer. It may be across the entire winding, or only a portion of the winding, or even across an independent winding tightly coupled to the secondary winding. As the primary winding of the transformer is no longer proportional to the output voltage, the feedback required to control the voltage regulator must now be taken from the secondary in some manner, such as a tightly coupled low voltage winding as depicted in FIG. 2. Such a transformer may be fabricated by winding primary and secondary windings on different legs of a magnetic core, and by the addition of a magnetic shunt path between the primary and secondary circuits.

Figure 3:
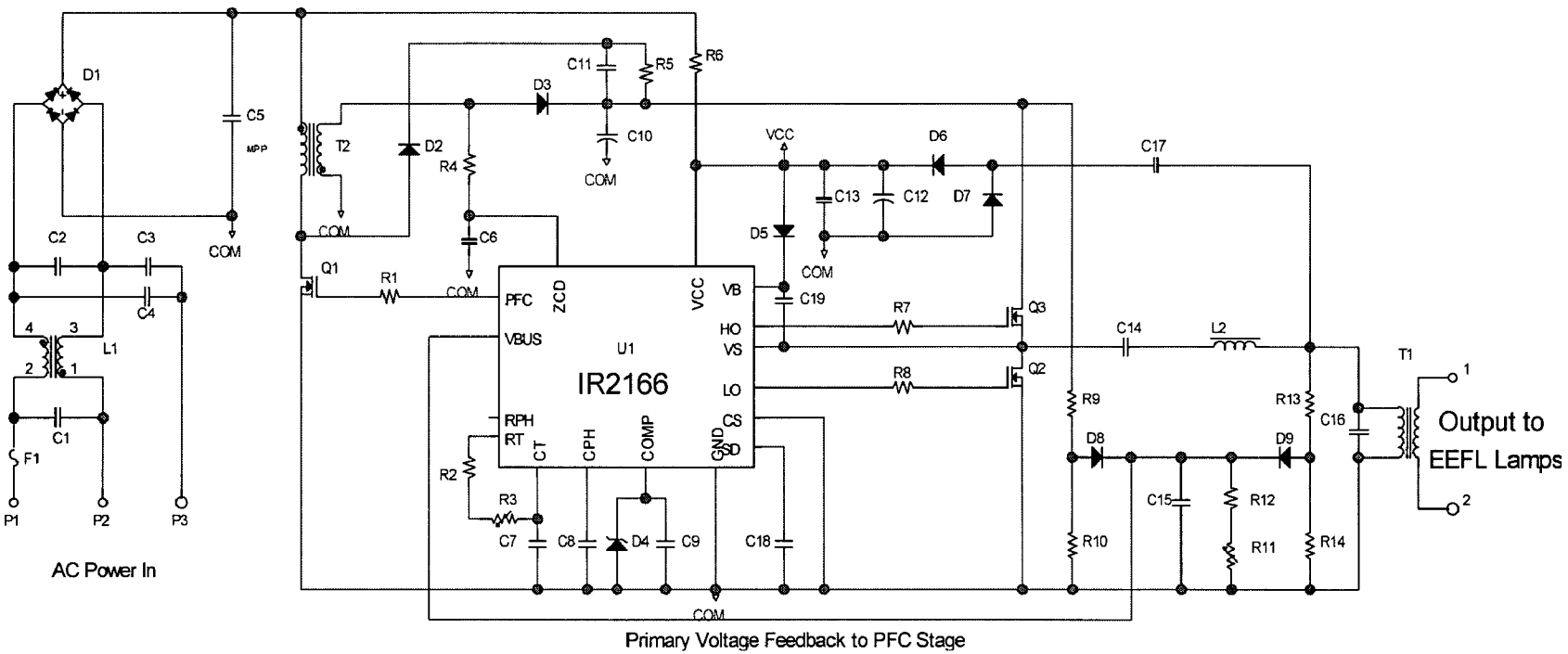
FIG. 3 is a circuit diagram of an embodiment according to the invention.

FIG. 3 shows one practical implementation of the circuit. In this circuit an IR2166 control IC is utilized as it can provide both the power factor correction function to provide voltage regulation, and also a self-oscillating half bridge driver for the output stage.

The input AC power to the unit is fed to a conventional EMI filter comprising C1, C2, C3, C4 and L1, and thence to bridge rectifier D1. The DC output of the bridge rectifier has a small capacitor across its output to suppress noise generated by the action of the PFC stage, and to provide low impedance at the high frequency at which the PFC stage operates. The capacitor is sufficiently small that the output of the bridge rectifier is essentially half sinusoidal raw rectified AC.

The DC from the bridge rectifier is fed to the PFC stage, consisting of mosfet Q1 and flyback transformer T2, and is controlled by U1. The circuit operates in the discontinuous mode in this particular implementation, and output power from the secondary charges capacitor C10 via diode D3. The voltage on C10 is then used to drive the output half bridge, Q3 and Q4. A snubbing circuit comprising D2, C11 and R5 limits spike amplitude on the drain of Q1. Resistor R4 provides an input to the control IC to indicate that the secondary of T2 has discharged following a fly back cycle, and that another PFC cycle can be initiated.

The frequency of the self-oscillating output stage is set by R2, R3 and C7, and alternately turns on and off Q2 and Q3 at half the oscillator frequency. The voltage at the junction of Q2 and Q3 is a square wave whose peak-to-peak amplitude will be close to the value of the DC voltage on C10. The DC component of this voltage is blocked by capacitor C14 and then fed to the resonant inductor L2. Capacitor C16 is arranged to resonate with L2 at a frequency that is equal to, or slightly lower than the applied voltage from C14 with the minimum specified lamp load. Adding additional lamps will lower the resonant frequency due to the electrode capacitance of the EEFL lamps. The resulting resonant voltage is applied to the primary of the step-up transformer T1 to provide the required operating voltage for the EEFL lamps.

The voltage on the primary of T1 may be controlled to the desired level by means of the feedback loop that controls the PFC stage and hence the voltage on C10. The voltage on the primary of T1 is attenuated by resistors R13 and R14, and then rectified by diode D9. R11 and R12 are the burden resistors for the rectifier, and C15 filters out the high frequency ripple. The purpose of R14 is to reduce the reverse voltage across D9 and so allow a small signal low leakage diode to be used for D9. This makes for a more thermally stable unit as the thermally sensitive leakage current is reduced by this approach. The resulting DC voltage across C15 is then fed to the input of the control amplifier for the PFC stage, where it is compared with an internal reference voltage, and the resulting error signal used to adjust the operation of the PFC stage in such a way that the voltage on C10 is maintained at a level that will provide the correct lamp voltage as the load is increased, resulting in a change in resonant frequency and lowering of the circuit Q.

With such an arrangement, increasing the load beyond the maximum design load could result in an excessively high voltage appearing on C10 that could result in the destruction of Q2, Q3 and other components. To prevent this, resistors R9 and R10 form an attenuator for the bus voltage on C10. The voltage appearing across R10 is the "ORed" with the voltage on C15 by means of diode D8. As the voltage on the primary of T1 falls due to increased load, the input voltage to the PFC control amplifier is maintained at the level of the internal reference voltage. This then maintains the voltage on C10 at a safe level.

Figure 4:
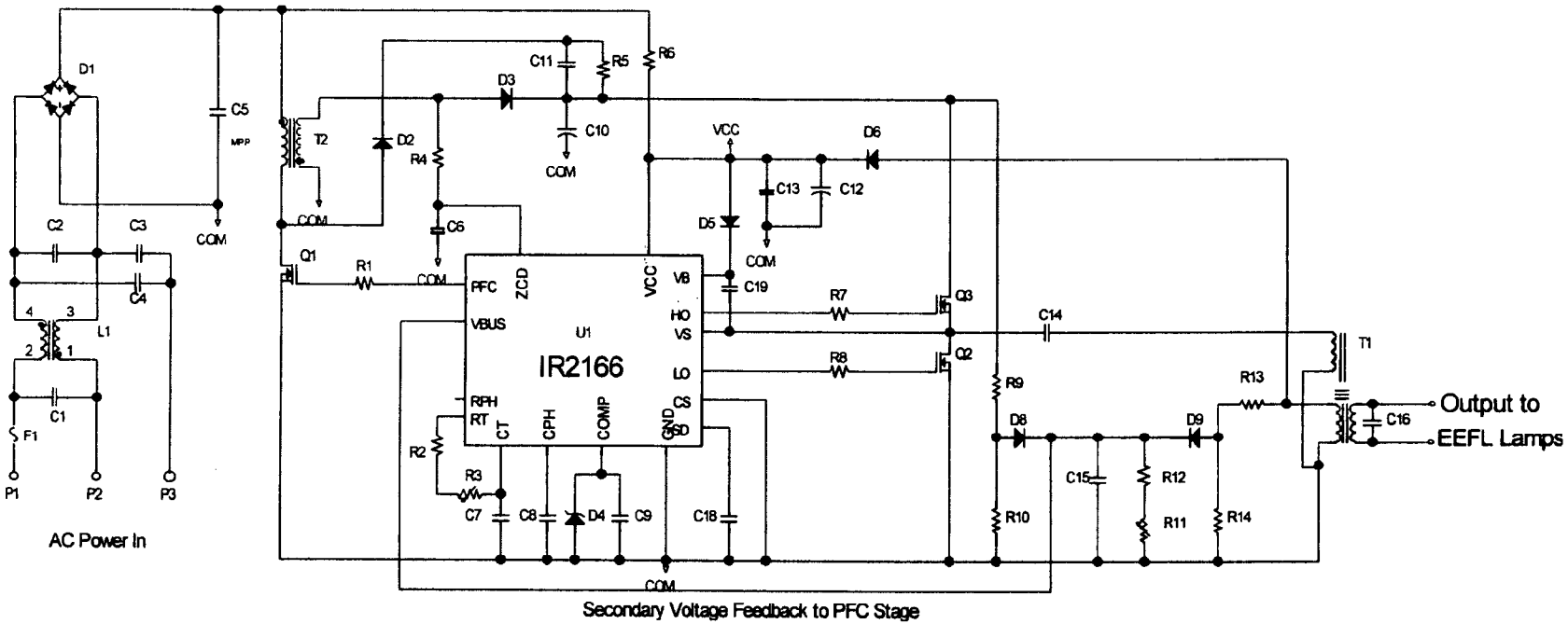
FIG. 4 is a circuit diagram of an embodiment using a high leakage reactance transformer.

FIG. 4 shows the same circuit configured to use a high leakage reactance transformer. T1 is the high reactance transformer with a sensing winding tightly coupled to the high voltage secondary. This is now used to generate the feedback voltage to control the power factor stage DC output voltage. In addition, it is also used to provide operating bias for the IC after rectification by D6. In all other respects the circuit is identical to that of FIG. 3.

The circuit according to the preferred embodiment provides a output minimizes changes in lamp current compared to waveform variations that can occur with a non-sinusoidal signal.

The over-protection circuit between the controllable voltage regulator and the output inverter prevents excessive voltage being presented to the output inverter in the event that the load exceeds the design maximum or the output is short circuited.

Although preferred embodiments of the invention have been disclosed, the invention is not limited to the embodiments illustrated and covers any modifications or equivalents which would occur to one of ordinary skill in the art. The scope of the invention is defined by the claims.

We claim:

1. A power supply circuit for providing power for a plurality of external electrode fluorescent lamps (EEFLs) connected in parallel, comprising:

a controllable voltage regulator for receiving an input power signal and for providing a regulated voltage signal;

an output inverter and a resonant circuit connected to receive the regulated voltage signal and for providing a resonant frequency signal;

a voltage transformation stage for receiving the resonant frequency signal for transforming the resonant frequency signal to a power voltage signal capable of driving a plurality of EEFLs connected in parallel;

wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

2. The power supply circuit according to claim 1, wherein the resonant circuit comprises an inductor and capacitor.

3. The power supply circuit according to claim 1, wherein the voltage transformation stage comprises a step-up voltage transformer.

4. The power supply circuit according to claim 1, wherein the resonant circuit and voltage transformation state comprise a single magnetic component in the form of a transformer having a high leakage reactance between primary and secondary windings, to provide a step up transformer and an inductor, the inductor forming the resonant circuit with a capacitor.

5. The power supply circuit according to claim 1, further comprising an input rectifier for receiving an AC voltage input power signal and for providing a rectified signal to the controllable voltage regulator.

6. The power supply circuit according to claim 1, wherein the resonant frequency supply voltage has a power factor of at least 0.9.

7. The power supply circuit according to claim 1, wherein the power voltage signal is a sinusoidal wave form signal having a voltage of about 2200-2400 VAC and a frequency of about 65-80 kHz.

8. The power supply circuit according to claim 1, further comprising an over-voltage protection circuit between the controllable voltage regulator and output inverter.

9. The power supply circuit according to claim 1, wherein the output inverter produces a rectangular waveform signal and wherein the resonant circuit provides a sinusoidal signal of about 150-180 volts RMS at a frequency of about 65-80 kHz.

10. A power supply circuit for providing power for a plurality of external electrode fluorescent lamps (EEFLs) connected in parallel, comprising:

an input rectifier for receiving an AC voltage input power signal and for rectifying the AC voltage input power signal into a rectified signal;

a controllable voltage regulator for receiving the rectified signal and for providing a regulated voltage signal;

an over-voltage protection circuit for receiving the regulated supply voltage signal and for suppressing any over-voltage conditions on the regulated voltage signal;

an output inverter and a resonant circuit connected to receive the regulated voltage signal and for providing a resonant frequency signal;

a voltage transformation stage for receiving the resonant frequency signal and for stepping up the voltage to a higher voltage suitable for providing a power voltage for a plurality of EEFLs, wherein the controllable voltage regulator is connected to receive the resonant frequency signal and is responsive thereto to keep the resonant frequency signal within an acceptable operating voltage range to power the EEFLs independently of the number of EEFLs connected to receive the power voltage signal.

11. The power supply circuit according to claim 10, wherein the resonant circuit and voltage transformation state comprise a single magnetic component in the form of a transformer having a high leakage reactance between primary and secondary windings, to provide a step up transformer and an inductor, the inductor forming the resonant circuit with a computer.

12. The power supply circuit according to claim 10, wherein the resonant frequency supply voltage has a power factor of at least 0.9.

13. The power supply circuit according to claim 10, wherein the power voltage signal is a sinusoidal wave form signal having a voltage of about 2200-2400 VAC and a frequency of about 65-80 kHz.

14. The power supply circuit according to claim 10, further comprising an over-voltage protection circuit between the controllable voltage regulator and output inverter.

* * * * *